US005950236A

United States Patent [19]

Andrew et al.

[11] Patent Number: 5,950,236

[45] Date of Patent: Sep. 14, 1999

[54] METHOD OF COLLECTING HAIR CLIPPINGS DURING A HAIRCUT AND A DEVICE THEREFOR

[75] Inventors: Vladimir Andrew, 39, allée de la Robertsau, F-67000 Strasbourg; Roger Himber, Rixheim, both of France

[73] Assignee: Vladimir Andrew, Strasbourg, France

[21] Appl. No.: 08/945,131

[22] PCT Filed: Apr. 22, 1996

[86] PCT No.: PCT/IB96/00363

§ 371 Date: Oct. 14, 1997

§ 102(e) Date: Oct. 14, 1997

[87] PCT Pub. No.: WO96/33637

PCT Pub. Date: Oct. 31, 1996

[30] Foreign Application Priority Data

Apr. 26, 1995 [CH] Switzerland ..... 1189/95

[51] Int. Cl.[6] ..... A41B 13/00; A41B 13/10

[52] U.S. Cl. ..... 2/50; 2/49.5

[58] Field of Search ..... 2/50, 468, 48, 2/49.1, 49.2, 49.4, 49.5, 129, 135; 132/212, 213

[56] References Cited

U.S. PATENT DOCUMENTS

| | | |
|---|---|---|
| 121,921 | 12/1871 | Winn . |
| 1,062,497 | 5/1913 | Parkhurst . |
| 1,094,345 | 4/1914 | Robertson et al. . |
| 1,261,575 | 4/1918 | McLeod . |
| 1,488,444 | 3/1924 | Shea . |
| 1,516,590 | 11/1924 | Dorsey . |
| 1,560,347 | 11/1925 | Gambon . |
| 1,635,613 | 7/1927 | Ellerhorst . |
| 1,992,769 | 2/1935 | Post . |
| 2,161,350 | 6/1939 | Hartzman . |
| 2,199,334 | 4/1940 | Ferry . |
| 2,243,505 | 5/1941 | Mercer . |
| 2,364,568 | 12/1944 | Tiscornia . |
| 2,527,098 | 10/1950 | Kenna . |
| 2,717,389 | 9/1955 | Girbble et al. . |
| 2,892,909 | 6/1959 | Darnutzer et al. . |
| 2,984,840 | 5/1961 | Parco . |
| 3,693,634 | 9/1972 | Gilbert . |
| 3,855,631 | 12/1974 | Ettinger . |
| 4,689,830 | 9/1987 | Williams . |
| 4,713,274 | 12/1987 | Minor . |
| 5,054,124 | 10/1991 | Darvas . |
| 5,133,084 | 7/1992 | Martin . |
| 5,469,580 | 11/1995 | Sobol . |

FOREIGN PATENT DOCUMENTS

| | | |
|---|---|---|
| 328 453 | 7/1903 | France . |
| 806 279 | 6/1951 | Germany . |
| 20 08 062 | 8/1971 | Germany . |
| 481 603 | 11/1969 | Switzerland . |
| 2 256 577 | 12/1992 | United Kingdom . |
| 2 264 234 | 8/1993 | United Kingdom . |

*Primary Examiner*—John J. Calvert
*Assistant Examiner*—Shirra L. Jenkins
*Attorney, Agent, or Firm*—Panitch Schwarze Jacobs & Nadel, P.C.

[57] ABSTRACT

For the collection of hair clippings (21) during cutting of the hair of a person, a collar (1) is fitted around his/her neck. The collar (1) has a surface on which the hair clippings (21) falling from the person's head are caught. The surface is coated with an adhesive for that purpose.

4 Claims, 3 Drawing Sheets

AIR

METHOD OF COLLECTING HAIR CLIPPINGS DURING A HAIRCUT AND A DEVICE THEREFOR

BACKGROUND OF THE INVENTION

An object of the invention is a method for collecting hair cuttings during cutting of hair with shears or with an electric cutting device, in which the hair cuttings are caught and retained in the shoulder region immediately following seperation from the head hair by a catching device installed there. An object of the invention is furthermore a device for collecting hair cuttings during cutting the hair with shears or with an electrical haircutting device, including a collar which is designed and constructed to be laid on the neck of a person in order to catch hair cuttings.

During hair care by cutting, not only long, but also to the greatest extent very short, hair cuttings accumulate which do not fall rapidly to the floor owing to their small mass, but are rather swirled around by air currents such as they exist in a room in which people move about and in which hair drying devices are in operation. Through these air currents, these fine and finest hair cuttings, in part only fractions of a millimeter long, can be breathed in and cause irritations and, if worse comes to worse, infections as well in respiratory organs, on the skin and even in the eyes.

With a device known from GB-A 2256577, the hairs are held fast by electrostatic charging of a drape (cape) which can be laid around the neck during the haircut. Maintaining an electrostatic charge over a long period of time, as is necessary in cutting hair, is difficult, and it is not guaranteed that the hairs will be held fast when the electrostatic charge is reduced in the cape, and thereby get into the environment once again. In particular, fine hair cuttings can get into the environment when the cape is removed after the haircut and taken away.

Furthermore, with the device known from DE-PS 806 279 the hair cuttings are continuously sucked off on a frustum-shaped collar, through whose upper opening the head must be passed, and on whose conic surface suction openings are present. Such a device, if the suction is to be effective, is very loud and unpractical, as the hair dresser must work at a great distance from the hair.

From GB-A-2 264 234, a collar-like hair collection container is also known which (similar to a bib for children) can be hung around the neck. This hair collection container is very stiff and uncomfortable to wear, and hardly solves the problem of small hair cuttings flying around, as these only lie on the surface of the container owing to their weight, but can come off again at any time.

SUMMARY OF THE INVENTION

The object of the present invention now consists in creating a process and a device which make it possible to collect the hair cuttings immediately after cutting and thereby prevent them from spreading in the area.

This object is accomplished by a procedure in which the hair cuttings fall and are retained on a collar which is laid around the neck and has an adhesive or wet surface which takes up the hairs, and by a device wherein the surface of the collar has an adhesive coating or is irrigated with water.

By seizing the hair cuttings immediately after cutting, that is after the shortest falling height possible, their spread is effectively prevented. By seizing the hair cuttings on an adhesive surface of the collar, as well as by additional collection of the same in an almost self-contained trough at the lower end of the collar, further spreading of the hair cuttings is no longer possible.

In a particularly advantageous embodiment, the adhesive surface is applied to a paper or a plastic sheet, which can be disposed of after the haircut with the hairs sticking to it. Preferably several adhesive layers are produced lying above one another in the form of a package, so that a new one is available immediately after use. To prevent a soiling of the new adhesive layer before use and removal of the adhesive or carrier layer loaded with hairs, a separating sheet can be placed between the individual sheets.

In a further embodiment the hair cuttings, which get out below over the edge of the adhesive surface, can be continuously or periodically removed by vacuuming from the trough and, if necessary, be chopped up into smaller pieces during the vacuuming for intermediate storage in the smallest area and in preparation for elimination.

In a further embodiment of the invention the removal of the hairs can be assisted by water, which is conducted over the collecting surface. The hairs are carried along there and led out of the trough. The water not only serves as a means of transport before it reaches the trough, but also as an adhesive which hinders the hair cuttings from leaving the support surface again.

In a further special embodiment of the invention, the collar is statically charged, and the hairs adhere through their opposite charge on the collecting surface. They first come off after the elimination of the static charge, and then fall off of the surface when the collar is cleaned or can be rubbed off from the latter.

BRIEF DESCRIPTION OF THE DRAWINGS

The invention will be explained in greater detail on the basis of illustrated embodiments. Depicted are.

DETAILED DESCRIPTION OF THE INVENTION

Figure 1:
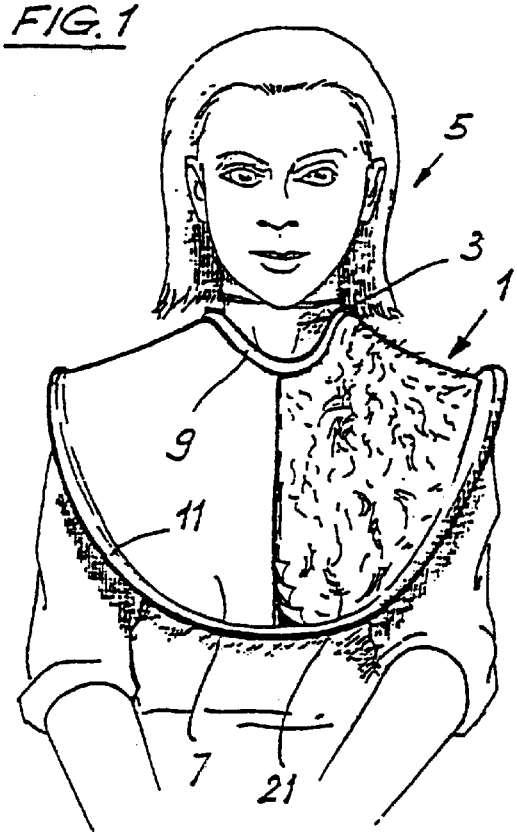
FIG. 1 is a representation of a collar from the front, which is laid around the neck of a person, without hair cuttings on the one half and with hair cuttings on the other half.
Figure 2:
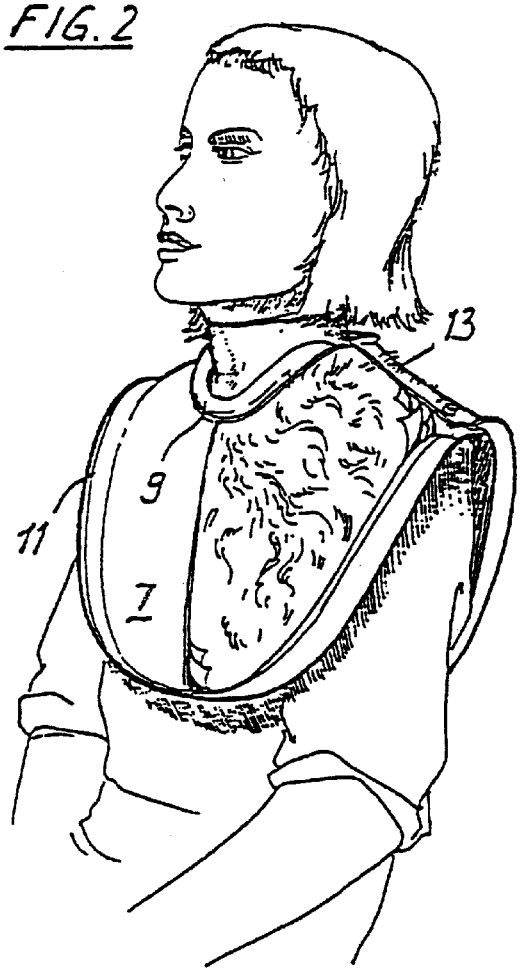
FIG. 2 is a representation of a collar obliquely from the front.
Figure 3:
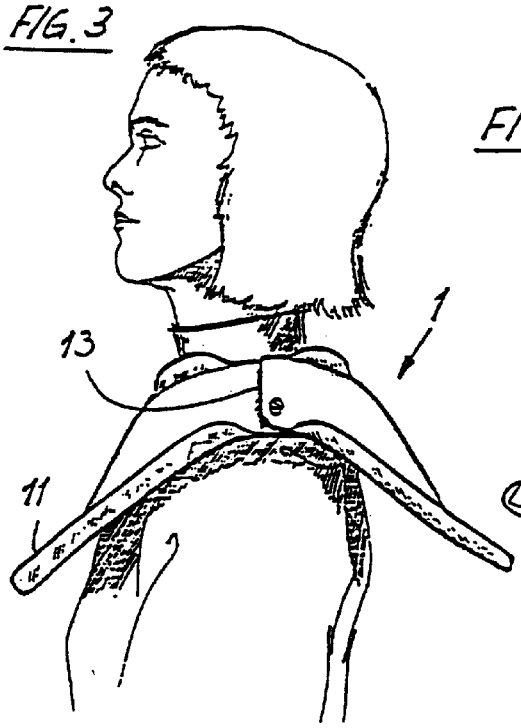
FIG. 3 is a representation of a collar from the side, laid around the neck of a person.

The collar 1 of the invention encircles the neck 3 of a person 5, who is sitting on the chair of a barber or a hair dresser. The collar 1 (laid around the neck of the customer) has a collection area 7 to which a neck element 9, constructed to block access of hair cuttings 21 behind the collar 1, can be attached from above. The neck element 9 is advantageously interchangeable, for example made of crepe paper, which is installed anew for each customer. Below or along the edges the collecting surface 7 is bounded by a trough-shaped edge region 11 curved upwardly or to the front, which prevents larger hair cuttings 21 from going over the edge of the collar 1. The collar 1 is cut open either in front (FIG. 4) or over the shoulders at position 13, and can be spread at this point when pulled over the head. In the representation in FIG. 4, means 15 for closing the collar 1 are indicated. These can be snap fasteners, VELCRO (hook and loop fasteners) or similar closing means.

On the neck element 9, a tube-shaped bulge 25, which is filled with air during the haircut, can be installed to seal against hair cuttings 21 which can get between the collar 1 and the neck 3 of the person. Filling with air can take place with a small balloon-shaped bellows.

Figure 4:
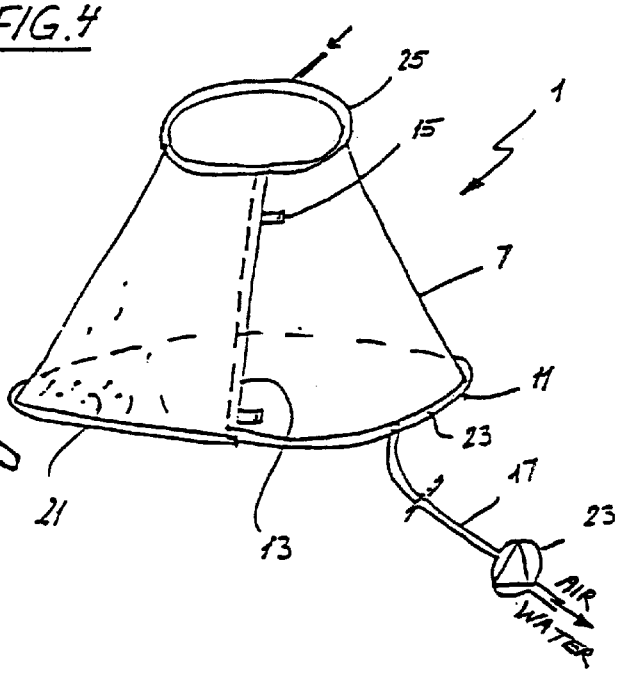
FIG. 4 is a perspective representation of a collar with smooth surface and a collecting trough forming the lower edge.
Figure 6:
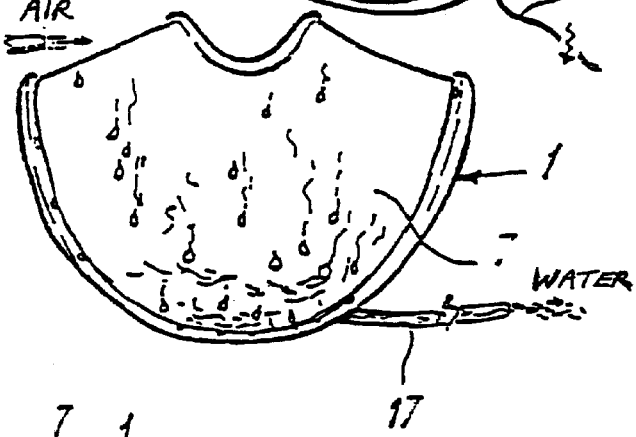
FIG. 6 is a further view of a collar with a collecting trough.

Furthermore, a tube-shaped conduit 17 is visible in FIGS. 4 and 6, which is connected first with a pump 19 and second with the interior or the trough-shaped edge region 11. With the pump 19 air or water can be drawn in through the conduit 17, and hair cuttings 21 carried along with the air or water stream can be led off from the edge region 11.

Figure 7:
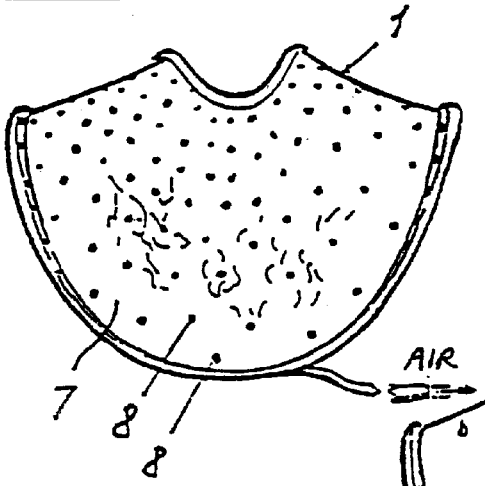
FIG. 7 is a view of a collar with suction ports for suction air in the collecting surface.

In the configuration of the invention according to FIG. 7 the collection surface 7 is constructed with holes 8 and connected with a suction pump (not depicted) on the backside.

The hair cuttings 21, which are cut off from the head hair by the barber with the shears or with an electric cutting machine, fall on the inclined collection surface 7 by the shortest path possible and are caught there. Hairs perhaps not adhering are held back in the edge region 11, which for example can be constructed as a nearly closed trough 23. The collar preferably remains connected with the source of suction, when it is removed from the neck 3 of the person 5.

Figure 8:
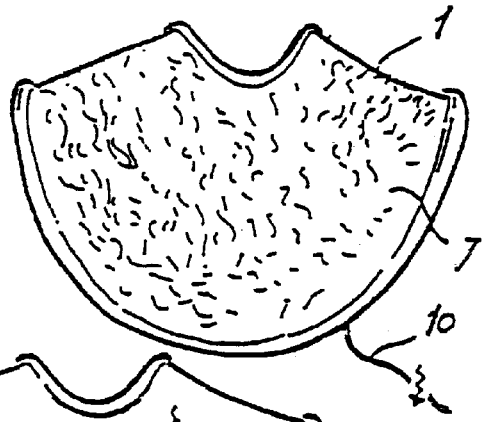
FIG. 8 is a view of a collar with an electrostatically chargeable surface.

In the configuration of the invention according to FIG. 8 the collection surface 7 is constructed as electrostatically chargeable, and for this is connected with an appropriate source of current 10. By generating an electrostatic charge of the surface of the collar 1 the hair cuttings are not only attracted by this when they fall down after cutting, but are also later held fast. The hair cuttings 21 can then be removed from the the collar 1 after the cutting, after the collar 1 is removed from the neck 3 of the person 5, and furthermore after the electrostatic charge is dissipated. They nonetheless remain held fast until this time.

Figure 9:
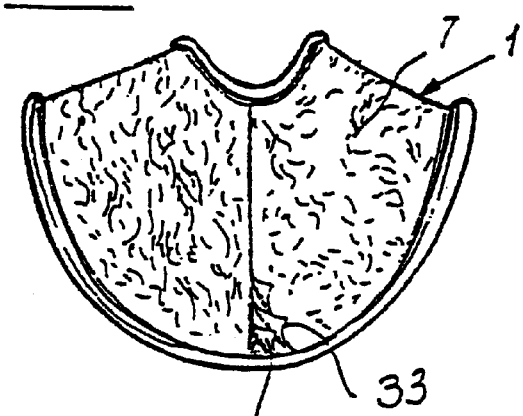
FIG. 9 is a view of a collar with adhesive surface.
Figure 5:
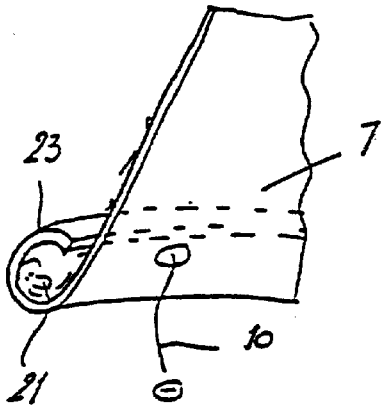
FIG. 5 is a longitudinal section through the collar in FIG. 4.

In the configuration of the invention according to FIG. 9, the surface of the collection surface 7 or the entire collar 1 is covered with an adhesive layer 29, which catches the hair cuttings 21. The adhesive layer 29 can be constructed similar to that of a fly paper, and consequently be configured for one time use. The adhesive layer 29 can be applied to a carrier material or a carrier layer 31 of paper or a plastic sheet, as this is known from POST-IT note sheets (i.e., self-sticking removable note sheets). The use of a crepe-like carrier material 31, which makes possible a spatial fitting on the support, is especially advantageous. In this case, the carrier layer 31 on top of another with the hair cuttings 21 adhering thereon can be removed after use of the collar 1 and burned. If several carrier layers 31 are laid out package-like on the collar 1, the collar is again ready for use and collection immediately after removing the uppermost lying layer with the hair cuttings 21 sticking to it.

With sufficient internal stability or use of a greater number of carrier layers 31 lying one on top of another, the collar 1 provided for support can even be dispensed with, or this can at least be lighter in construction. In other words, the carrier layer 31 then itself forms the collar 1 and represents a disposable product.

In order that the new adhesive layer exposed after the haircut not be soiled immediately, before it is used with a new customer, a separation layer 33 can be inserted between each carrier layer 31. With a suitable choice of material, this separation layer 33 permits using an adhesive or glue with an extremely high adhesive capacity.

It is also possible to construct the adhesive layer such that the hair cuttings 21 lying on it remain stuck on during the haircut, but can be detached again by washing with water. In this embodiment of the invention, the collar 1 is made of plastic.

Figure 11:
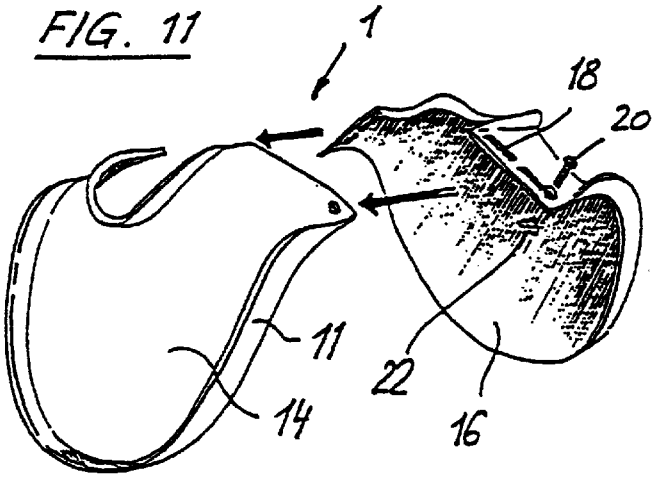
FIG. 11 is a collar constructed in two parts with a front and a back part, seen from the side, not joined together.
Figure 12:
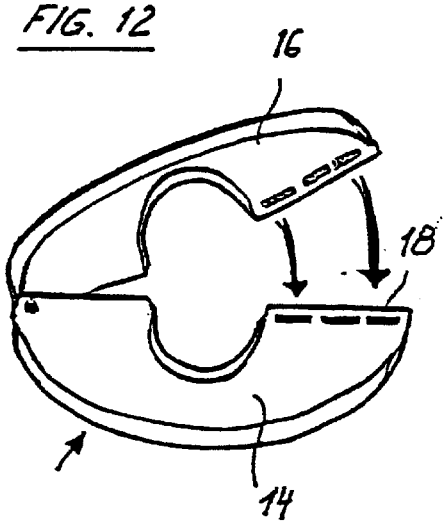
FIG. 12 is the collar in FIG. 11, viewed from above, partially joined together.
Figure 10:
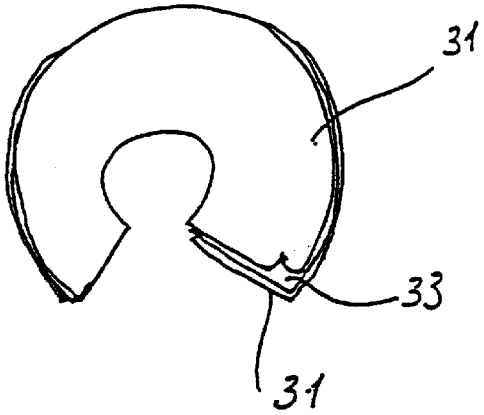
FIG. 10 shows the dispensing of a collar with adhesive sheets lying one upon another in accordance with FIG. 9.
Figure 13:
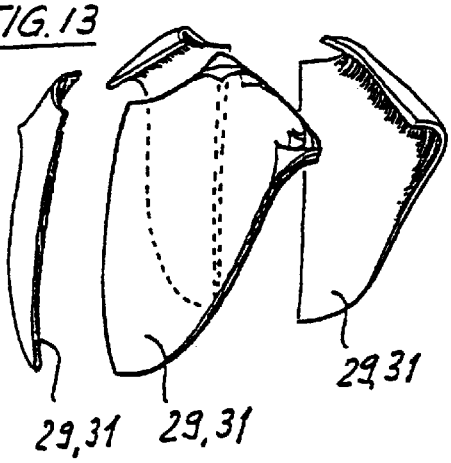
FIG. 13 is an adhesive sheet package for application on the collar elements.

In FIG. 11 the collar 1 comprises of a front part 14 and a back part 16. The two parts 14 and 16 can be joined to each other above by VELCRO (hook and loop fasteners) or similar adhesive strips 18. The connection can also take place laterally through a joint, including a bolt or a screw 20 with nut 22. The two parts 14 and 16 can be constructed alike or unlike. They are preferably made of a not too hard plastic material, so that they can lie on the chest and the back while being worn.

Figure 14:
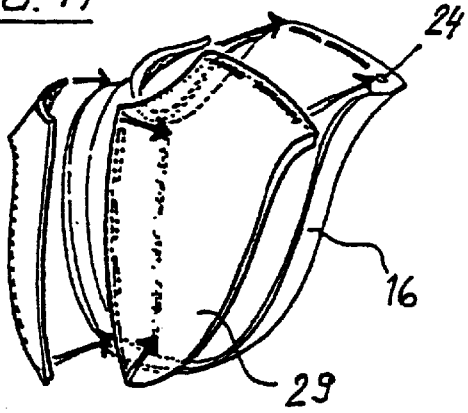
FIG. 14 is an adhesive sheet package for application on the collar elements.
Figure 15:
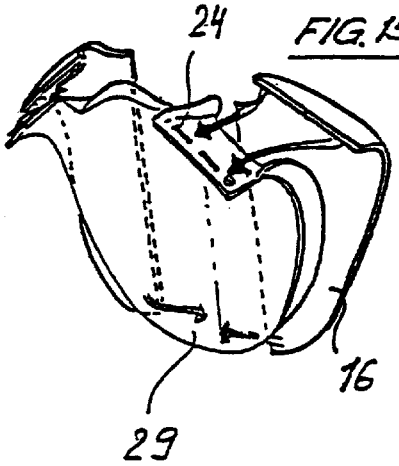
FIG. 15 is an adhesive sheet package for application on the collar elements.

If the two parts 14 and 16 are constructed as carriers for the adhesive sheets 31, then arresting means 24 can be attached for fastening the sheets 31 (FIGS. 14 and 15).

Figure 16:
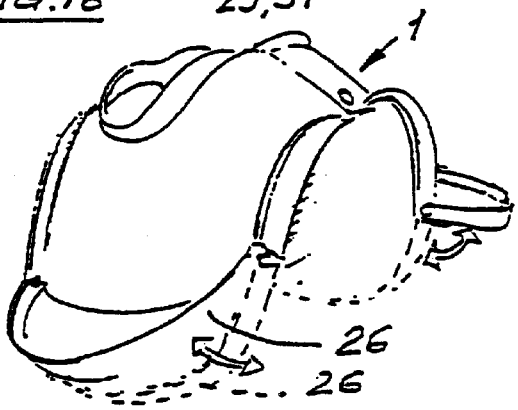
FIG. 16 is a collar with an additional hair collector for long hair dressing.

In the configuration of the invention according to FIG. 16 additional collection containers 26 are installed on the lower rims. These serve to catch the cuttings when cutting the ends (tips) of very long hair. The collection container 26 is preferably swivellably linked with the front and/or back part 14, 16. It is also possible to apply the carrier layer or adhesive sheet 31 to the surface of the container 26.

The separation layer 33 and/or the carrier layer 31 can be provided with advertising printings and/or also be scented.

We claim:

1. A collar device for collecting hair cuttings during a hair cut, said collar device comprising a plurality of carrier layers in the form of a generally annular collar having an upper end and a lower end, each layer including a collection surface extending between said upper and lower ends completely around said generally annular collar and having an adhesive substantially covering said entire collection surface for catching hair cuttings and, each carrier layer adhering to each successive carrier layer in a peelable detachable fashion.

2. The collar device according to claim 1, wherein said carrier layer is made of paper.

3. The collar device according to claim 1, wherein said carrier layer is made of plastic.

4. The collar device according to claim 1, wherein a separation layer is contained between said carrier layers.

* * * * *